US011215355B2

(12) United States Patent
Zhang

(10) Patent No.: US 11,215,355 B2
(45) Date of Patent: Jan. 4, 2022

(54) AIR ENERGY BOILER

(71) Applicant: Jin Zhang, Qingdao (CN)

(72) Inventor: Jin Zhang, Qingdao (CN)

( * ) Notice: Subject to any disclaimer, the term of this patent is extended or adjusted under 35 U.S.C. 154(b) by 166 days.

(21) Appl. No.: 16/607,872

(22) PCT Filed: Mar. 30, 2018

(86) PCT No.: PCT/CN2018/081422
§ 371 (c)(1),
(2) Date: Oct. 24, 2019

(87) PCT Pub. No.: WO2018/205771
PCT Pub. Date: Nov. 15, 2018

(65) Prior Publication Data

US 2020/0191379 A1 Jun. 18, 2020

(30) Foreign Application Priority Data

May 10, 2017 (CN) ..... 201710323717.3

(51) Int. Cl.
*F22B 3/06* (2006.01)
*F24V 40/00* (2018.01)

(52) U.S. Cl.
CPC ..... *F22B 3/06* (2013.01); *F24V 40/00* (2018.05)

(58) Field of Classification Search
CPC .. F22B 3/06; F22B 33/00; F22B 33/18; F24V 40/00

(Continued)

(56) References Cited

U.S. PATENT DOCUMENTS 4,385,725 A * 5/1983 Pischlinger ..... F25B 27/00 237/12.1
4,438,729 A * 3/1984 Loesch ..... E21B 36/00 122/20 B (Continued)

FOREIGN PATENT DOCUMENTS

CN 201935392 U 8/2011
CN 102439263 A 5/2012

(Continued)

OTHER PUBLICATIONS

1st Office Action by Chinese Patent Office (CNIPA) dated Feb. 19, 2019 regarding the corresponding Chinese patent application.

*Primary Examiner* — Vivek K Shirsat
*Assistant Examiner* — Ko-Wei Lin
(74) *Attorney, Agent, or Firm* — KandareIP, LLC; Anthony W. Kandare

(57) ABSTRACT

The present invention discloses an air energy boiler and belongs to the technical field of energy conversion. A crankshaft of the boiler is fixed at the output end of a rotating unit. The crankshaft is provided with at least one bulge. A driving piston of each conversion assembly is arranged in an air cavity in a reciprocating motion. The driving piston divides the air cavity into a first cavity and a second cavity. A wrist pin is arranged in the second cavity, and the wrist pin is fixed and connected with the driving piston. Both ends of a piston rod is rotatably connected with the wrist pin and the corresponding bulge respectively. The first cavity is provided with an air intake. Multiple heating pipes are in communication with the first cavity at one end and stretch into the boiler body at the other end. The boiler body is sealed and stores water, and the boiler body is provided with a steam outlet, wherein the steam outlet of the boiler body is connected to various terminals through the use of pipe- (Continued)

lines. Since air is used as the heat source, no conditional limitations exist for installation, and it is safe to use and saves energy and electricity.

6 Claims, 2 Drawing Sheets

(58) Field of Classification Search
USPC ..... 122/26; 126/247
See application file for complete search history.

(56) References Cited

U.S. PATENT DOCUMENTS 4,711,204 A * 12/1987 Rusconi ..... F01P 3/20 122/26
5,279,262 A * 1/1994 Muehleck ..... F16D 57/00 122/26
5,704,320 A * 1/1998 Ban ..... F24V 40/00 123/142.5 R
5,743,467 A * 4/1998 Ban ..... B60H 1/038 237/12.3 R
5,755,379 A * 5/1998 Ito ..... B60H 1/00978 237/12.3 R
5,778,843 A * 7/1998 Inoue ..... F24V 40/00 123/142.5 R
5,881,711 A * 3/1999 Ban ..... F24V 40/00 126/247
5,884,839 A * 3/1999 Aoki ..... F01P 3/20 237/12.3 R
5,887,559 A * 3/1999 Ban ..... F24V 40/00 123/142.5 R
5,897,056 A * 4/1999 Morikawa ..... F24V 40/00 237/12.3 R
5,911,361 A * 6/1999 Suzuki ..... F24V 40/00 237/12.3 R
5,931,380 A * 8/1999 Aoki ..... F24V 40/00 237/12.3 B
5,954,120 A * 9/1999 Aoki ..... B60H 1/038 165/43
6,027,032 A * 2/2000 Aoki ..... B60H 1/038 237/12.3 R
6,047,896 A * 4/2000 Moroi ..... F24V 40/00 237/12.3 R
6,244,232 B1 * 6/2001 Ban ..... F24V 40/00 123/142.5 R
2002/0011524 A1 * 1/2002 Suzuki ..... B60H 1/03 237/19

FOREIGN PATENT DOCUMENTS

CN 202927816 U 5/2013
CN 105757969 A 7/2016
WO 2015127910 A1 9/2015

* cited by examiner

AIR ENERGY BOILER

RELATED APPLICATIONS

This application is a United States National Stage Application filed under 35 U.S.C 371 of PCT Patent Application Serial No. PCT/CN2018/081422, filed Mar. 30, 2018, which claims Chinese Patent Application Serial No. CN 201710323717.3, filed May 10, 2017, the disclosure of all of which are hereby incorporated by reference in their entirety.

TECHNICAL FIELD

The invention belongs to the technical field of energy conversion, and especially relates to an air energy boiler.

BACKGROUND

A boiler is used as an energy conversion device. The input energy charged into the boiler body includes chemical energy in coal, electric energy, solar energy, and other thermal energy conversion forms, and the output is a heat carrier having certain heat energy such as steam, high-temperature water and the like.

In the process of implementing the present invention, the Applicant found the following problems in the prior technology:

Regarding the thermal energy conversion form which utilizes chemical energy combustion, the temperature of the boiler extracting water and water pressure are greatly affected by climatic conditions, which makes it instable and difficult to adjust the water temperature. Moreover, combustion leads to high energy consumption along with discharge of a large amount of toxic exhaust, and the service life is short.

The thermal energy conversion form which utilizes electric energy mainly has the disadvantages of high energy consumption and easy leakage of electricity which causes injuries.

The thermal energy conversion form which utilizes solar energy is theoretically the most energy-saving, but considering the actual situation that the weather is often rainy and cloudy in a real environment and there is a need for additional electricity support in winter in the north of China, it is equivalent to an electric water heater with large safety hazard. Moreover, the vacuum tube generally used by solar energy is extremely fragile; the maintenance is troublesome; and the service life is relatively short.

SUMMARY

In view of the above problems in the prior technology, the present invention provides an air energy boiler.

The present invention achieves the above objectives by the following technical solutions:

An air energy boiler, characterized in that the boiler comprises a rotating unit, a crankshaft, a boiler body, and at least one conversion assembly, wherein the crankshaft is fixed and mounted at the output end of the rotating unit, and the crankshaft has at least one bulge arranged in one-to-one correspondence with the conversion assembly; each conversion assembly comprises a piston rod, an air cavity, a driving piston, a wrist pin, and multiple heating tubes, wherein the driving piston is slidably arranged in the air cavity and divides the air cavity into a first cavity and a second cavity; the wrist pin is arranged in the second cavity and directly connected with the driving piston; both ends of the piston rod are rotatably connected to the wrist pin and the corresponding bulge 6, respectively; the first cavity is provided with an air intake; the multiple heating pipes are in communication with the first cavity at one end and stretch into the boiler body at the other end; the boiler body is sealed and stores water and is provided with steam outlet, the steam outlet of the boiler body being connected to terminals via pipelines.

Alternatively, the bulge is formed by bending a corresponding portion of the piston rod.

Alternatively, the bulge is fixed and arranged on the corresponding position of the piston rod.

Further, each bulge is directly provided with two first stop plates, wherein the two first stop plates are located on both sides of the piston rod to stop the displacement of the piston rod.

Further, the crankshaft is provided with a flywheel at one end that is away from the rotating unit.

Further, the wrist pin is arranged parallel to the driving piston, and both ends of the wrist pin are fixed and mounted on the driving piston via two connecting plates arranged relative to each other.

Even further, the wrist pin is fixed and provided with two second stop plates, and the two second stop plates are fixed and arranged on both sides of the piston rod to stop the displacement of the piston rod.

Further, a one-way valve is installed in the air intake, through which gas is charged into the first cavity, and gas leakage is prevented.

Still further, the boiler further comprises an air tank, which is in communication with the one-way valve of the air intake in the air cavity in each conversion assembly.

Preferably, the pipeline that connects the air tank and each one-way valve is provided with a pressure relief valve, and the pressure passing through the one-way valve can be adjusted to a preset range by adjusting the pressure relief valve.

The beneficial effects of the invention are as follows:

In the air energy boiler of the present invention, the output end of the rotating unit rotates and drives the bulge on the crankshaft to rotate; the bulge drives the driving piston to slide in the air cavity via the wrist pin; then air is delivered to the first cavity; the sliding of the driving piston in the air cavity makes the air in the first cavity of the air cavity compressed and generate heat; the heat-generating air enters the heating tubes, heats water in the boiler body and evaporates the water into steam; and the steam is discharged to various terminals through a steam outlet.

The air energy boiler of the present invention can quickly reach the required use temperature by using air as heating energy source, and there are no conditional restrictions on its installation. Moreover, there is no electric shock risk since it does not have any electrical element that directly contacts with water. It is safe to use, has the characteristic of saving energy and electricity, and can avoid the problems in the above background technology. Furthermore, compared with the thermal energy conversion forms in the background technology, it has the characteristics of shorter time, faster response and higher temperature.

BRIEF DESCRIPTION OF THE DRAWINGS

In order to illustrate the technical solutions in the example of the present invention more clearly, the drawings used in the description of the example are described briefly hereinbelow. It is obvious that the drawings as described hereinbelow are only illustrative of some of the examples of the present invention. For a person of ordinary skill in the technology, he may also obtain other drawings according to those drawings without doing inventive work.

DETAILED DESCRIPTION OF THE EMBODIMENTS

The technical solutions in the example of the present invention are clearly and completely described hereinbelow with reference to the accompanying drawings in the example of the present invention. It is obvious that the described example is only part of the examples of the present invention, but not all of the examples. All other examples obtainable by those of ordinary skill in the technology based on the example of the present invention without doing inventive work are within the protection scope of the present invention.

The example of the present invention discloses an air energy boiler that uses air to heat and generate energy.

Figure 1:
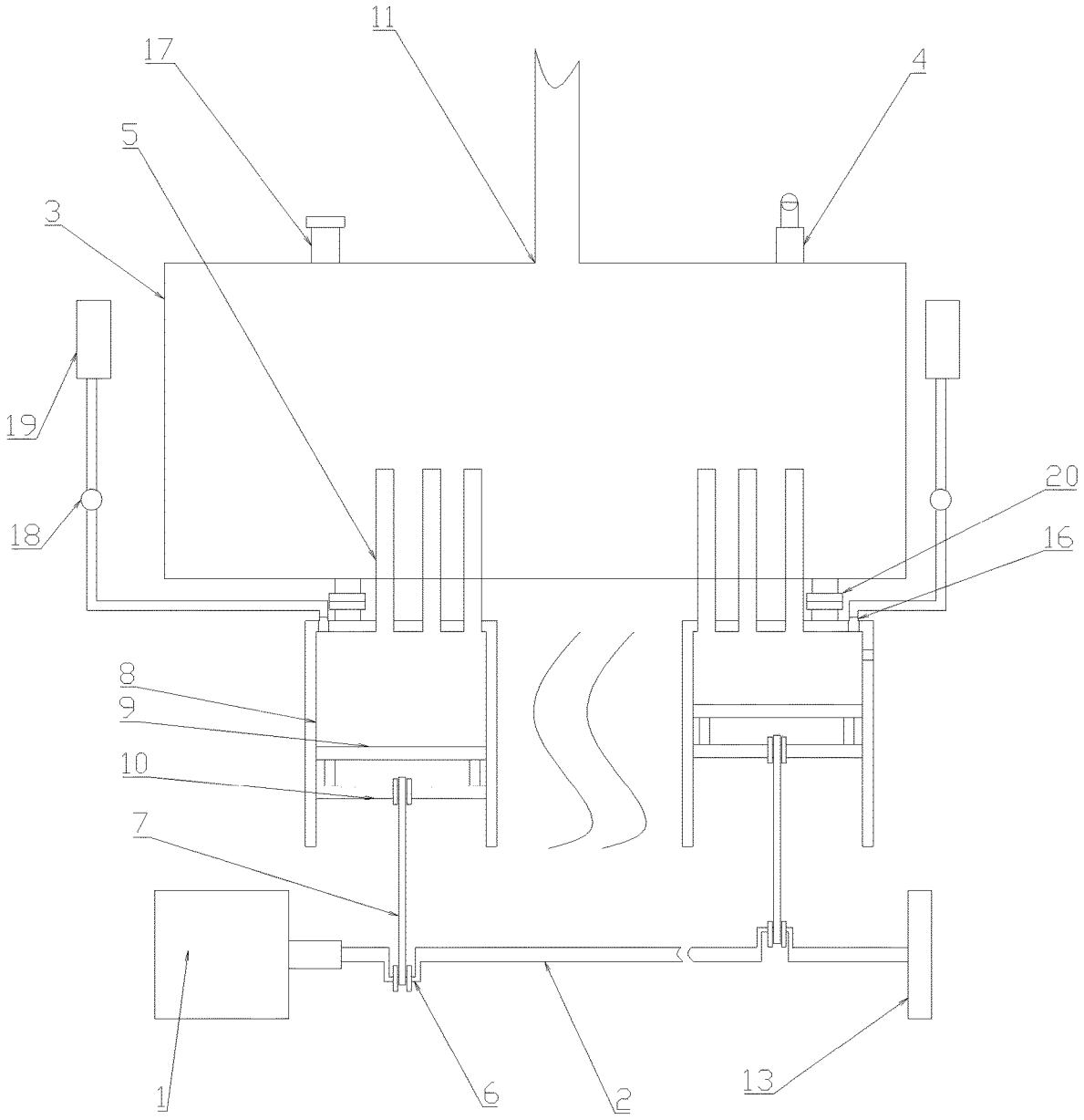
FIG. 1 is a schematic structural view of an air energy boiler according to an example of the present invention.
Figure 2:
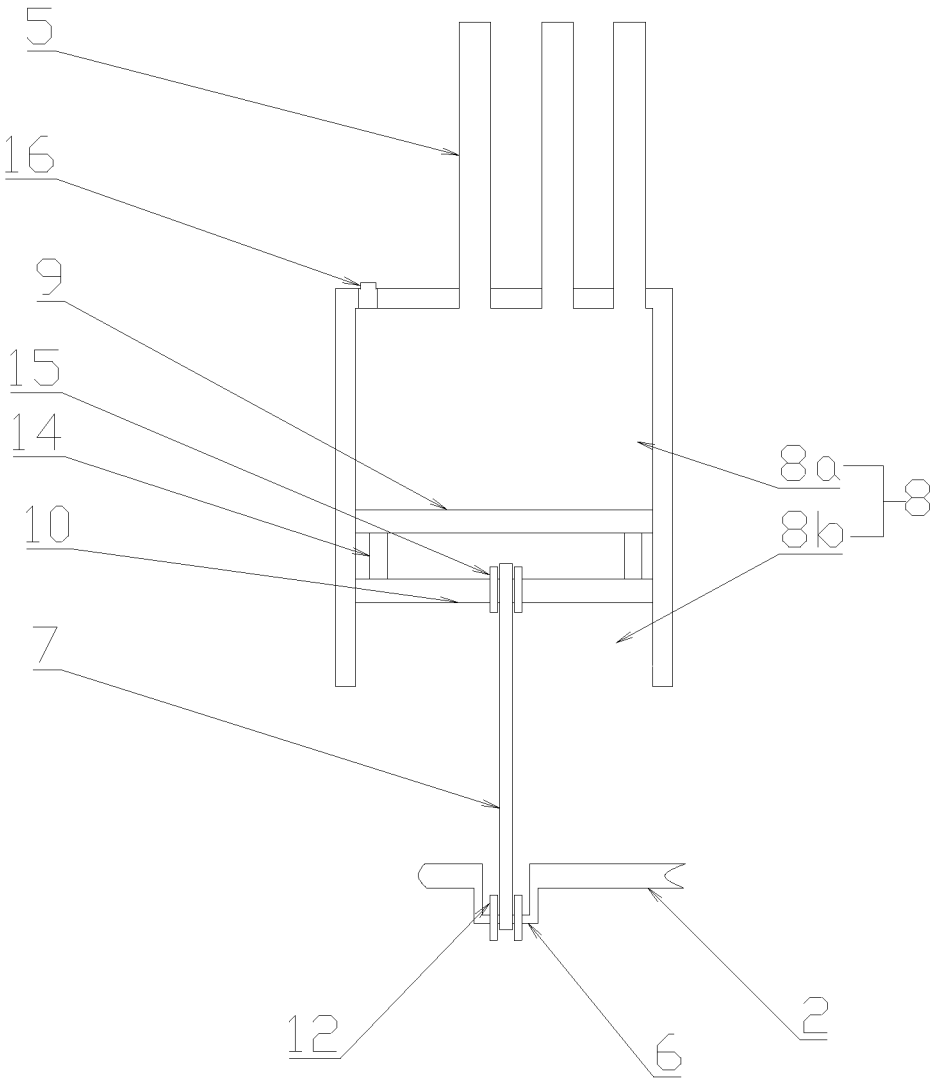
FIG. 2 is a schematic structural view of a conversion assembly of an air energy boiler according to an example of the present invention.

FIG. 1 is a schematic structural view of an air energy boiler according to the example invention. By referring to FIG. 1, the air energy boiler comprises a rotating unit 1, a crankshaft 2, a boiler body 3, and at least one conversion assembly 'a'. The crankshaft 2 is fixed and mounted at the output end of the rotating unit 1, and the crankshaft 2 has at least one bulge 6 arranged in one-to-one correspondence with the conversion assembly 'a'. FIG. 2 is a schematic structural view of a conversion assembly of an air energy boiler. By referring to FIG. 2, each conversion assembly 'a' comprises a piston rod 7, an air cavity 8, a driving piston 9, a wrist pin 10, and multiple heating tubes 5, and the driving piston 9 is slidable within the air cavity 8 and divides the air cavity 8 into a first cavity 8*a* and a second cavity 8*b*. The wrist pin 10 is arranged in the second cavity 8*b* and fixed and directly connected to the driving piston 9. Both ends of the piston rod 7 are rotatably connected to the wrist pin 10 and the corresponding bulge 6, respectively. The first cavity 8*a* is provided with an air intake. The multiple heating pipes 5 are in communication with the first cavity 8*a* at one end and stretch into the boiler body 3 at the other end. The boiler body 3 is sealed and stores water and is provided with a steam outlet 11. The steam outlet 11 of the boiler body 3 is connected to terminals through the use of pipelines.

In the air energy boiler, the output end of the rotating unit rotates and drives the rotation of the bulge on the crankshaft; the bulge drives the driving piston to slide in the air cavity via the wrist pin; then air is delivered to the first cavity; the sliding of the driving piston in the air cavity makes the air in the first cavity compressed and generate heat; the heated air enters the heating tubes, heats water in the boiler body and evaporates the water into steam; and the steam is discharged to various terminals through the use of pipelines.

The air energy boiler can quickly reach the required temperature by using air as the heating energy source, and there are no conditional restrictions on its installation. Moreover, there is no electric shock risk since it does not have any electrical element that directly contacts with water. It is safe to use, has the characteristics of saving energy and electricity, and can avoid the problems in the above background technology. Furthermore, compared with the thermal energy conversion forms in the background technology, it has the characteristics of shorter time, faster response and higher temperature. The rotating unit may be a rotating cylinder or an electric motor with a high-power transmission. The specific structure of the rotating unit is not limited in the example of the present invention.

With the Air energy boiler, the rotation speed of the rotating unit is adjustable, so that the temperature of the air in the first cavity and the time to heat the water can be adjusted by adjusting the rotation speed of the rotating unit, and in turn, this will raise the heat input to the boiler.

By referring to FIG. 1, the bulges 6 are n-shaped and can be formed by bending a corresponding portion of the piston rod 7.

It is apparent that the bulges 6 and the piston rods 7 in the example of the present invention may also be two separate components. The bulges 6 are fixed and arranged on the corresponding positions of the piston rods 7 by welding or the like, which is not limited in the example of the present invention.

Further, by referring to FIG. 2, each of the bulges 6 of the example of the present invention may be fixed and provided with two first stop plates 12, and the two first stop plates 12 are located on both sides of the piston rod 7 to stop the displacement of the piston rod 7.

The first stop plates 12 of the example of the present invention may be mounted on the bulges 6 by welding or threaded connection. By referring to FIG. 1, the crankshaft 2 of the example of the present invention may be provided with a flywheel 13 at one end that is away from the rotating unit. The flywheel 13 can store a certain amount of energy, so that the crankshaft 2 has a relatively large moment of inertia.

In the example of the present invention, the crankshaft 2 may also be supported by multiple supporting bases. A bearing may be configured in the middle of the supporting base, and the crankshaft 2 is placed in through the bearing to ensure that the rotation of the crankshaft 2 is stable.

By referring to FIG. 2, the wrist pin 10 of the example of the present invention may be arranged parallel to the driving piston 9, and both ends of the wrist pin 10 are fixed and mounted on the driving piston 9 via two connecting plates 14 disposed relative to each other.

Furthermore, by referring to FIG. 2, the wrist pin 10 of the example of the present invention may be fixed and provided with two second stop plates 15, and the two second stop plates 15 are fixed and arranged on both sides of the crankshaft 7 to stop the displacement of the piston rod 7.

In the example of the present invention, the second cavity 8*b* may either be unsealed or sealed. If the second cavity 8*b* is sealed, it is necessary to arrange a space in the second cavity 8*b* for the piston rod 7 to rotate.

By referring to FIG. 2, in the example of the present invention, a one-way valve 16 can be installed in the inflation inlet. When gas is charged into the sealed cavity, the one-way valve is opened. After the completion of gas charge, the one-way valve 16 is closed to prevent leakage of air.

By referring to FIG. 1, the boiler further includes an air tank 19 which is in communication with the one-way valve 16 of the air intake in the air cavity of each conversion assembly. Charging gas to all of the air cavities can be completed by one air tank 19.

It is apparent that the air tanks 19 in the example of the present invention may also be arranged in one-to-one correspondence with the one-way valve 16, that is, each air tank 19 delivers gas to one air cavity, which is not limited in the example of the present invention.

By referring to FIG. 1 and FIG. 2, a pressure relief valve 18 can be arranged on the pipeline that connects the air tank 19 and each one-way valve 16 in the example of the present invention, and the pressure passing through the one-way valve 16 can be adjusted to a preset range by adjusting the pressure relief valve 18.

By referring to FIG. 1, a flange connection 20 may be arranged between the air cavity 8 and the boiler body 3 in the example of the present utility model to ensure that the heating tubes are mounted stably.

In addition, by referring to FIG. 1, in the example of the present invention, a safety valve 17 can be mounted on the boiler body 3. In normal use, the safety valve 17 is in a closed state. When the pressure rise in the boiler body 3 exceeds a prescribed value, the steam can be discharged through the safety valve 17 to ensure the boiler safety.

Moreover, by referring to FIG. 1, in the example of the present invention, a pressure controller 4 can be mounted on the boiler body 3, and the pressure controller 4 can display the pressure value in the boiler body 3 and adjust the pressure in the boiler body 3 to control the discharge temperature of water steam.

The above example is a preferred embodiment of the present invention, and is merely illustrative of the present invention, and does not limit the present invention in any form. Any equivalent examples, which are obtained by those of ordinary skill in this technology through making variations or modifications based on the technical contents disclosed in the present invention within the scope of the technical features of the present invention and without departing from the contents of the technical features of the present invention, are still within the scope of the technical features of the present invention.

What is claimed is:

1. An air energy boiler, characterized in that the boiler comprises, a rotating unit, a crankshaft, a boiler body, and at least one conversion assembly, wherein the crankshaft is fixed and mounted at an output end of the rotating unit, and the crankshaft has at least one bulge arranged in one-to-one correspondence with the at least one conversion assembly; each conversion assembly comprises a piston rod, an air cavity, a driving piston, a wrist pin, and multiple heating tubes, wherein the driving piston is slidably arranged in the air cavity and divides the air cavity into a first cavity and a second cavity; the rotating unit is configured to heat air in the first cavity; the wrist pin is arranged in the second cavity and fixed and connected with the driving piston; both ends of the piston rod are rotatably connected to the wrist pin and the corresponding bulge, respectively; the first cavity is provided with an air intake;

the multiple heating tubes are in communication with the first cavity at one end and stretch into the boiler body at the other end; the boiler body is sealed and stores water and is provided with a steam outlet, the steam outlet of the boiler body is configured to be connected to terminals via pipelines;

wherein the rotation speed of the rotating unit is adjustable, such that the temperature of the air in the first cavity and the time to heat the water are adjustable by the rotation speed of the rotating unit;

wherein a one-way valve is installed in each air intake;

wherein the boiler further comprises an air tank, and wherein for each conversion assembly, a pipeline is provided to connect an air tank and its respective one-way valve, and the pipeline is provided with a pressure relief valve.

2. The air energy boiler according to claim 1, characterized in that each of the at least one bulge connects a corresponding piston rod.

3. The air energy boiler according to claim 1, characterized in that each bulge is fixed and provided with two first stop plates, wherein the two first stop plates are located on both sides of corresponding piston rod.

4. The air energy boiler according to claim 1, characterized in that the crankshaft is provided with a flywheel at one end that is away from the rotating unit.

5. The air energy boiler according to claim 1, characterized in that each wrist pin is arranged parallel to respective driving piston, and both ends of each wrist pin are fixed and mounted on respective driving piston via two spaced-apart connecting plates.

6. The air energy boiler according to claim 1, characterized in that each wrist pin is fixed and provided with two second stop plates that are arranged on both sides of respective piston rod.

* * * * *